US011254893B2

(12) United States Patent
Basu

(10) Patent No.: US 11,254,893 B2
(45) Date of Patent: Feb. 22, 2022

(54) LUBRICATING COMPOSITION

(71) Applicant: The Lubrizol Corporation, Wickliffe, OH (US)

(72) Inventor: Shubhamita Basu, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 42 days.

(21) Appl. No.: 16/623,004

(22) PCT Filed: Jun. 7, 2018

(86) PCT No.: PCT/US2018/036409
§ 371 (c)(1),
(2) Date: Dec. 16, 2019

(87) PCT Pub. No.: WO2018/236592
PCT Pub. Date: Dec. 27, 2018

(65) Prior Publication Data

US 2021/0163841 A1 Jun. 3, 2021

Related U.S. Application Data

(60) Provisional application No. 62/522,126, filed on Jun. 20, 2017.

(51) Int. Cl.

| | |
|---|---|
| ***C10M 137/10*** | (2006.01) |
| ***C10M 169/04*** | (2006.01) |
| ***C10M 101/00*** | (2006.01) |
| *C10N 30/00* | (2006.01) |
| *C10N 40/00* | (2006.01) |
| *C10N 30/04* | (2006.01) |
| *C10N 30/06* | (2006.01) |
| *C10N 30/10* | (2006.01) |
| *C10N 30/14* | (2006.01) |
| *C10N 40/08* | (2006.01) |
| *C10N 40/12* | (2006.01) |

(52) U.S. Cl.
CPC ..... *C10M 169/04* (2013.01); *C10M 101/00* (2013.01); *C10M 137/10* (2013.01); *C10M 2223/047* (2013.01); *C10N 2030/04* (2013.01); *C10N 2030/06* (2013.01); *C10N 2030/10* (2013.01); *C10N 2030/14* (2013.01); *C10N 2030/24* (2020.05); *C10N 2030/45* (2020.05); *C10N 2030/66* (2020.05); *C10N 2040/08* (2013.01); *C10N 2040/12* (2013.01); *C10N 2040/135* (2020.05)

(58) Field of Classification Search
CPC ..... C10M 169/04; C10M 101/00; C10M 137/10; C10M 2223/047; C10N 2040/08; C10N 2030/66; C10N 2030/24; C10N 2040/135; C10N 2030/45; C10N 2040/12; C10N 2030/06; C10N 2030/10; C10N 2030/04; C10N 2030/14
USPC ..... 508/433
See application file for complete search history.

(56) References Cited

U.S. PATENT DOCUMENTS

| | | | | |
|---|---|---|---|---|
| 2010/0105590 | A1* | 4/2010 | Nagakari | C10M 141/00 508/508 |
| 2011/0287989 | A1 | 11/2011 | Filippini | |
| 2013/0017982 | A1 | 1/2013 | Ikai | |
| 2016/0032214 | A1 | 2/2016 | Shinoda | |

FOREIGN PATENT DOCUMENTS

| | | | |
|---|---|---|---|
| EP | 1529830 A1 | 5/2005 | |
| EP | 2826847 A1 * | 1/2015 | C10M 141/10 |
| EP | 2826847 A1 | 1/2015 | |

* cited by examiner

*Primary Examiner* — Prem C Singh
*Assistant Examiner* — Francis C Campanell
(74) *Attorney, Agent, or Firm* — Eryn Ace Fuhrer; Teresan W. Gilbert

(57) ABSTRACT

A hydraulic lubricating oil composition is provided which contains a synergistic mixture of three phosphorous antiwear components in order to provide good thermal stability and good demulsibility to the lubricating oil composition.

28 Claims, No Drawings

LUBRICATING COMPOSITION

CROSS REFERENCE TO RELATED APPLICATION

This application claims priority from PCT Application Serial No. PCT/US2018/036409 filed on Jun. 7, 2018, which claims the benefit of U.S. Provisional Application No. 62/522,126 filed on Jun. 20, 2017; the entirety of both applications is hereby incorporated by reference.

The present invention relates to a lubricating oil composition comprising a synergistic combination of three phosphorous compounds which provide the lubricating composition with enhanced thermal stability as well as good demulsibility and antiwear performance.

BACKGROUND

There is increasing interest in lubricating compositions that contain ashless additives due to environmental concerns and potential toxicity issues. In some applications, the use of antiwear additives such as ZDDP is being reduced in favor of other ashless additives. As a result, there is a need to provide lubricating compositions that contain ashless additives while still providing antiwear performance at least as good as, or even better than, metal containing additives.

In addition, for hydraulic equipment, an increase in pressure is accompanied by an increase in temperature of the lubricating oil, therefore, the thermal stability of lubricating oil compositions used for hydraulic equipment is very important. However, many ashless hydraulic lubricating oil compositions do not perform acceptably in thermal stability tests. Thus, there is a need for ashless or reduced metal-containing lubricating oil compositions that have good thermal stability.

For oils subject to water contamination and turbulence, the ability of the water and oil to separate is important. It is also desirable for a hydraulic lubricating composition to perform well in demulsibility tests.

SUMMARY OF THE INVENTION

The present invention provides a lubricating composition for use in a hydraulic system, turbine system, or a circulating oil system. A hydraulic system is generally a device or apparatus in which pressure is applied to a fluid, typically an oil-based fluid, to transmit energy to different parts of the system. A turbine lubricant is typically used to lubricate the gears or other moving parts of a turbine (or turbine system), such as a steam turbine or a gas turbine. A circulating oil is typically used to distribute heat to or through a device or apparatus through which it is circulated.

A useful hydraulic lubricating oil comprises an oil of lubricating viscosity and an additive package that includes a synergistic mixture of three phosphorous antiwear agents. For example, the present invention includes (A) an oil of lubricating viscosity; (B) a first additive (1) represented by the formula

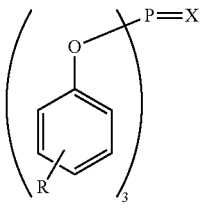

wherein R is a hydrogen or an alkyl group having 3 to 9 carbon atoms, for example 3, 4, 5, 6, 7, 8, 9, or mixtures thereof, and X may be an oxygen atom or sulfur atom or combinations thereof; (C) a second additive (2) represented by the formula

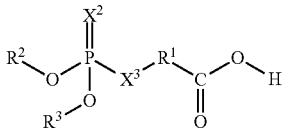

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and (D) a third additive (3) represented by the formula

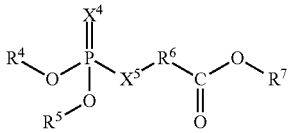

wherein $R^4$, $R^5$, and $R^7$ are each independently a linear or branched saturated or unsaturated cyclic aliphatic hydrocarbon group having 1 to 18 carbon atoms or a branched or unbranched saturated or unsaturated cyclic hydrocarbon group having 5 to 18 carbon atoms, $R^6$ is a linear or branched alkylene group having 1 to 8 carbon atoms, $X^4$ and $X^5$ are each independently an oxygen atom or sulfur atom or combinations thereof. In one embodiment, additive (1), additive (2), and additive (3) are present in the lubricating composition in sufficient amounts to provide at least about 200 ppm phosphorous to the lubricating composition.

In one embodiment, the lubricating composition may be ashless. In another embodiment, the lubricating composition may be free of transition metals. In another embodiment, the lubricating composition may contain Calcium as the only metal in the composition.

The lubricating composition may also include additional additives as further explained herein.

Oils of Lubricating Viscosity

One component (a) of the disclosed technology is an oil of lubricating viscosity, also referred to as a base oil. The base oil may be selected from any of the base oils in Groups I-V of the American Petroleum Institute (API) Base Oil Interchangeability Guidelines, namely

| Base Oil Category | Sulfur (%) | Saturates (%) | Viscosity Index |
|---|---|---|---|
| Group I | >0.03 and/or | <90 | 80 to 120 |
| Group II | ≤0.03 and | ≥90 | 80 to 120 |
| Group III | ≤0.03 and | ≥90 | >120 |
| Group IV | All polyalphaolefins (PAOs) | | |
| Group V | All others not included in Groups I, II, III or IV | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as polyalkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can be used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

In some embodiments the industrial lubricant composition may also include a minor amount of one or more non-synthetic base oils. Examples of these non-synthetic base oils include any of those described herein, including API Group I, Group II, or Group III base oils.

The amount of the oil of lubricating viscosity present is typically the balance remaining after subtracting from 100 wt % the sum of the amount of the compounds of the invention and the other performance additives. The oil of lubricating viscosity can be present in a major amount, for a lubricant composition, or in a concentrate forming amount, for a concentrate and/or additive composition. The industrial lubricant composition of the invention may be either lubricant compositions or concentrate and/or additive compositions.

In a fully formulated lubricating oil composition in accordance with the present invention, the oil of lubricating viscosity is generally present in a major amount (i.e. an amount greater than 50 percent by weight). Typically, the oil of lubricating viscosity is present in an amount of 75 to 98 percent by weight, and often greater than 80 percent by weight of the overall composition.

The various described oils of lubricating viscosity may be used alone or in combinations. The oil of lubricating viscosity (considering all oil present) may be used in the described industrial lubricant compositions in the range of about 40 or 50 percent by weight to about 99 percent by weight, or from a minimum of 49.8, 70, 85, 93, 93.5 or even 97 up to a maximum of 99.8, 99, 98.5, 98 or even 97 percent by weight.

In still other embodiments the oil of lubricating viscosity may be used from 60 to 97, or from 80 to 97, or even from 85 to 97 percent by weight. Put another way, the compositions described herein may contain at least 60, 80, or even 85 percent by weight oil of lubricating viscosity.

In concentrate compositions, typically the amount of additives and other components remains the same, but the amount of oil of lubricating viscosity is reduced, in order to make the composition more concentrated and more efficient to store and/or transport. A person skilled in the art would be able to easily adjust the amount of oil of lubricating viscosity present in order to provide a concentrate and/or additive composition.

Phosphorous Additives

Phosphorus compounds usable as the first additive (1) of the present invention are phosphorous compounds comprising triaryl phosphate or triaryl thiophosphate represented by a formula (1) below:

(1)

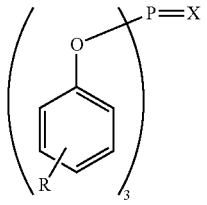

In the formula (1), R is a hydrogen atom or an alkyl group having 3 to 9 carbon atoms, for example 3, 4, 5, 6, 7, 8, 9, or combinations thereof of carbon atoms and X is an oxygen atom or a sulfur atom. In the formula (1), the three R groups may be mutually the same or different. Examples of the alkyl group having 4 or less carbon atoms include a methyl group, ethyl group, n-propyl group, isopropyl group, n-butyl group, isobutyl group and tertiary butyl group.

Examples of the phosphorus compound represented by the formula (1) include triphenyl phosphate, tricresyl phosphate, triphenyl thiophosphate, tricresyl thiophosphate, and butylated triphenyl phosphorothionate.

In one embodiment of the present invention one of the above phosphorus compounds may be used alone as the first additive (1) or a combination of two or more thereof may be used.

The phosphorous compound used as the second additive (2) in the present composition is a phosphorous compound comprising a compound represented by a formula (2) below.

(2)

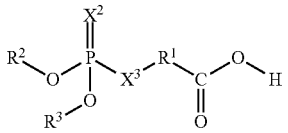

In the formula (2), R1 represents a linear or branched alkylene group having 1 to 8 carbon atoms, R2 and R3 each represent a hydrocarbon group having 3 to 20 carbon atoms, and $X^2$ and $X^3$ each, independently, represent an oxygen atom or sulfur atom.

In one embodiment, R1 may be a linear or branched alkylene group having 1 to 8 carbon atoms, more preferably a linear or branched alkylene group having 2 to 4 carbon atoms, and further preferably a branched alkylene group. Specifically, R1 is preferably, for instance, —CH2CH2-, —CH2CH(CH3)-, —CH2CH(CH2CH3)- or —CH2CH(CH2CH2CH3)-, and more preferably —CH2CH(CH3)- or —CH2CH(CH3)CH2-.

In one embodiment, R2 to R3 each preferably represent a linear or branched alkyl group having 3 to 8 carbon atoms, and more preferably a linear or branched alkyl group having 4 to 6 carbon atoms. Specifically, R2 to R3 is each preferably selected from the group consisting of propyl, isopropyl, butyl, isobutyl, pentyl, isopentyl, hexyl, 2-ethylbutyl, 1-methylpentyl, 1,3-dimethylbutyl and 2-ethylhexyl groups.

In one embodiment, both $X^2$ and $X^3$ represent oxygen atoms. In another embodiment, both $X^2$ and $X^3$ represent sulfur atoms. In another embodiment, $X^2$ is oxygen and $X^3$ is sulfur, and in another embodiment, $X^2$ is sulfur and $X^3$ is oxygen.

In the present composition, one of the above dithiophosphate compounds may be used alone as the second additive (2) or a combination of two or more thereof may be used.

The compound used as the third additive (3) in the present composition comprises a thiophosphate compound represented by a formula (3) below.

(3)

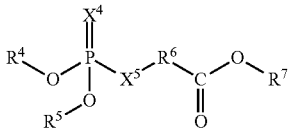

In the formula (3), $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R^6$ is a linear or branched alkylene group having 1 to 8 carbon atoms, $X^4$ and $X^5$ are each independently an oxygen atom or sulfur atom. In one embodiment of formula (3), at least one sulfur atom exists.

In one embodiment, both $X^4$ and $X^5$ represent oxygen atoms. In another embodiment, both $X^4$ and $X^5$ represent sulfur atoms. In another embodiment, $X^4$ is oxygen and $X^5$ is sulfur, and in another embodiment, $X^4$ is sulfur and $X^5$ is oxygen.

The lubricating composition of the present invention contains all of the additives (1), (2), and (3). In one embodiment, the additives (1), (2), and (3) are present in a ratio of 0.32-1.5 parts of additive (1) to 0.5-2.5 parts of additive (2) to 1 part of additive (3). In another embodiment, the additives (1), (2), and (3) are present in a ratio of 2.5 parts of additive (1) to 1.5 parts of additive (2) to 1 parts of additive (3). In another useful embodiment, additives (1), (2), and (3) are present in the lubricating composition in amounts sufficient to provide at least 200 ppm of phosphorous to the lubricating oil composition. This amount of phosphorous is necessary to provide sufficient antiwear protection for certain applications.

Other Additives

The lubricant composition may be in the form of a concentrate and/or a fully formulated lubricant. If the lubricant composition of the invention (comprising the additives disclosed herein) is in the form of a concentrate (which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

In addition to the 3 additives described above, the lubricant compositions may also contain one or more additional other additives. In some embodiments the additional additives may include an antioxidant, an anti-wear agent, a corrosion inhibitor, a rust inhibitor, a foam inhibitor, a dispersant, a demulsifier, a metal deactivator, a friction modifier, a detergent, an emulsifier, an extreme pressure agent, a pour point depressant, a viscosity modifier, or any combination thereof.

The lubricant may thus comprise an antioxidant, or mixtures thereof. The anti-oxidant may be present at 0 wt % to 4.0 wt %, or 0.02 wt % to 3.0 wt %, or 0.03 wt % to 1.5 wt % of the lubricant.

Anti-oxidants include diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof.

The diarylamine or alkylated diarylamine may be a phenyl-α-naphthylamine (PANA), an alkylated diphenylamine, or an alkylated phenylnaphthylamine, or mixtures thereof. The alkylated diphenylamine may include di-nonylated diphenylamine, nonyl diphenylamine, octyl diphenyl amine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnaphthylamines. In one embodiment, the diphenylamine is alkylated with a benzene and t-butyl substituent.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from BASF GmbH. A more detailed description of suitable ester-containing hindered phenol anti-oxidant chemistry is found in U.S. Pat. No. 6,559,105.

The antioxidant may include a substituted hydrocarbyl mono-sulfide represented by the formula:

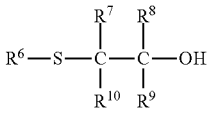

wherein $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

The lubricant compositions may also include a dispersant or mixtures thereof. Suitable dispersants include: (i) polyetheramines; (ii) borated succinimide dispersants; (iii) non-borated succinimide dispersants; (iv) Mannich reaction products of a dialkylamine, an aldehyde and a hydrocarbyl substituted phenol; or any combination thereof. In some embodiments the dispersant may be present at 0 wt % or 0.01 wt % to 2.0 wt %, 0.05 wt % to 1.5 wt %, or 0.005 wt % to 1 wt %, or 0.05 wt % to 0.5 wt % of the overall composition.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729.

Anti-foam agents, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the anti-foam is a polyacrylate. Antifoams may be present in the composition from 0.001 wt % to 0.012 wt % or 0.004 wt % or even 0.001 wt % to 0.003 wt %.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. In one embodiment, the demulsifier may be an oxyalkylated phenolic resin blend. Such a blend may comprise formaldehyde polymers with 4-nonylphenol, ethylene oxide and propylene oxide and formaldehyde polymers with 4-nonylphenol ethylene oxide. Demulsifier may be present in the composition from 0.002 wt % to 0.012 wt %.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant composition may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

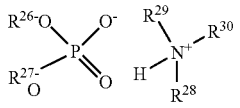

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a $C_{14}$ to $C_{18}$ alkylated phosphoric acid with Primene® 81R (produced and sold by Rohm & Haas) which is a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene® 81R or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid.

The rust inhibitors may be present in the range from 0 or 0.02 wt % to 0.2 wt %, from 0.03 wt % to 0.15 wt %, from 0.04 wt % to 0.12 wt %, or from 0.05 wt % to 0.1 wt % of the lubricating oil composition. The rust inhibitors may be used alone or in mixtures thereof.

The lubricant may contain a metal deactivator, or mixtures thereof. Metal deactivators may be chosen from derivatives of benzotriazole, 1,2,4-triazole, benzimidazole, 2-alkyldithiobenzimidazole, 2-alkyldithiobenzothiazole, or dimercaptothiadiazole. Examples of such derivatives include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole. The metal deactivators may also be described as corrosion inhibitors.

The metal deactivators may be present in the range from 0 or 0.001 wt % to 0.1 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

In one embodiment, the invention provides a lubricant composition further comprising a metal-containing detergent. In some embodiments, the metal-containing detergent may be a calcium or magnesium detergent. In one embodiment, the metal-containing detergent may also be an overbased detergent with total base number ranges from 30 to 500 mg KOH/g equivalents. In another embodiment, the metal-containing detergent may be a neutral detergent having a total base number of 0 to 30, or even 0 to 10, or even 30 or lower, or even 10 or lower mg KOH/g equivalents.

The metal-containing detergent may be chosen from non-sulfur containing phenates, sulfur containing phenates, sulfonates, salixarates, salicylates, and mixtures thereof, or borated equivalents thereof. The detergent may be borated with a borating agent such as boric acid such as a borated overbased calcium or magnesium sulfonate detergent, or mixtures thereof. The detergent may be present at 0 wt % to 5 wt %, or 0.001 wt % to 1.5 wt %, or 0.005 wt % to 1 wt %, or 0.01 wt % to 0.5 wt % of the hydraulic composition.

In one embodiment the lubricant disclosed herein may contain at least one friction modifier. The friction modifier may be present at 0 wt % to 3 wt %, or 0.02 wt % to 2 wt %, or 0.05 wt % to 1 wt %, of the lubricant composition.

As used herein the term "fatty alkyl" or "fatty" in relation to friction modifiers means a carbon chain having 8 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

The lubricating composition may also contain one or more viscosity modifiers. Any known viscosity modifier may be used. In one embodiment, the lubricating composition of the present invention is substantially free of or totally free of poly(meth)acrylates as viscosity modifiers. Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth)acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth)acrylic acid ester, an olefin copolymer or mixtures thereof. The viscosity modifiers may be present at 0 wt % to 10 wt %, 0.5 wt % to 8 wt %, 1 wt % to 6 wt % of the lubricant.

In one embodiment, all of the additives used in the lubricating composition may be ashless. In another embodiment, the lubricating composition may be free of additives that contain transition metals. In still another embodiment, the lubricating composition may contain additives where calcium is the only metal.

In one embodiment, the present invention provides a lubricating composition comprising: (A) an oil of lubricating viscosity; (B) a first additive (1) represented by the formula

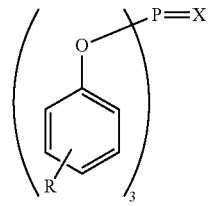

wherein R is a hydrogen or an alkyl group having 3 to 9 carbon atoms, and X is an oxygen atom or sulfur atom or combinations thereof (C) a second additive (2) represented by the formula

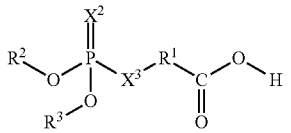

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and (D) a third additive (3) represented by the formula

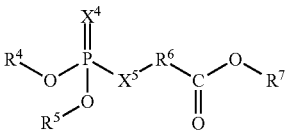

wherein $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R^6$ is a linear or branched alkylene group having 1 to 8 carbon atoms, $X^4$ and $X^5$ are each independently an oxygen atom or sulfur atom. In one embodiment, at least one sulfur atom is present in additive (3).

In one embodiment, additive (1), additive (2), and additive (3) may be present in the lubricating composition in sufficient amounts to provide at least about 200 ppm phosphorous to the lubricating composition.

In another embodiment, the present invention provides a lubricating composition comprising: (A) an oil of lubricating viscosity; (B) an antiwear additive package consisting of first additive (1) represented by the formula

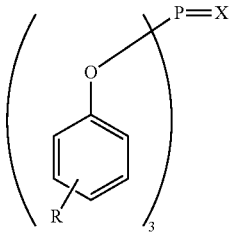

wherein R is a hydrogen or an alkyl group having 4 or fewer carbon atoms, and X is an oxygen atom or sulfur atom or combinations thereof; (C) a second additive (2) represented by the formula

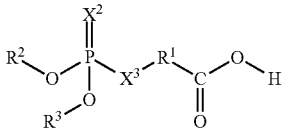

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and (D) a third additive (3) represented by the formula

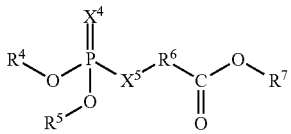

wherein $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R^6$ is a linear or branched alkylene group having 1 to 8 carbon atoms, $X^4$ and $X^5$ are each independently an oxygen atom or sulfur atom.

In one embodiment, additive (1), additive (2), and additive (3) are present in the lubricating composition in sufficient amounts to provide at least about 200 ppm phosphorous to the lubricating composition.

The invention also provides a method of lubricating a hydraulic system, a turbine system, or a circulating oil system comprising supplying to the hydraulic system, turbine system, or circulating oil system a lubricating composition comprising: (A) an oil of lubricating viscosity; (B) an anti-wear additive package, wherein the anti-wear additive package consists of 0.32 to 1.5 parts of first anti-wear additive (1) represented by the formula

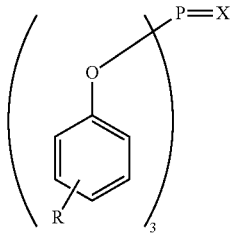

wherein R is a hydrogen or an alkyl group having 3 to 9 carbon atoms, and X is an oxygen atom or sulfur atom or combinations thereof; 0.5 to 2.5 parts of a second anti-wear additive (2) represented by the formula

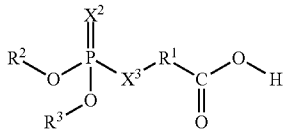

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and a 1 part of a third anti-wear additive (3) represented by the formula

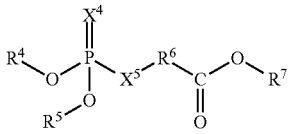

wherein $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R^6$ is a linear or branched alkylene group having 1 to 8 carbon atoms, $X^4$ and $X^5$ are each independently an oxygen atom or sulfur atom.

In one embodiment, at least one sulfur atom is present in additive (3). In one embodiment, the additive package is present in sufficient amounts to provide at least 200 ppm of phosphorous to the composition.

In one embodiment, the lubricating composition of the present invention is for use in a hydraulic system, turbine system or a circulating oil system. A hydraulic system is generally a device or apparatus in which pressure is applied to a fluid, typically an oil-based fluid, in order to transmit energy to different parts of the system. A turbine lubricant is typically used to lubricate the gears or other moving parts of a turbine (or turbine system), such as a steam turbine or a gas turbine. A circulating oil is typically used to distribute heat to or through a device or apparatus through which it is circulated.

Lubricating compositions of the present invention preferably show good demulsibility, good hydrolytic stability, and good thermal stability. The combination of the three anti-wear additives of the present invention provides lubricating composition that synergistically provides the following combination of properties: 3 ml of less, or even 2 ml or less, or even 1 ml or less, of oil and water emulsion as measured by ASTM D1401; results in the ASTM D2619 hydrolytic stability test in which water acidity is 4 mg or less, or even 3 mg or less, or even 3 mg or less, or even 1 mg or less KOH and the copper rating as determined by D130 is 2B or better; thermal stability measured by D2070 showing a copper rod rating of 5 or less, or less than 5, or even 4 or less, or even less than 4, a steel rod rating of 1, and total sludge content of 25 mg/100 ml or less, or even 20 mg/100 ml or less, or even 15 mg/100 ml or less, or even 12 mg/100 ml or less.

A set of hydraulic lubricating compositions was prepared as summarized in Table 1.

TABLE 1

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Hydraulic Addtive Package (% wt)[1] | 1 | 1 | 1 | 1 | 1 | 1 | 1 | 1 | 1 |
| Anti-Wear (1) (wt %) | 0.25 | | 0.25 | 0.25 | 0.25 | 0.5 | | | |
| Anti-Wear (2) (wt %) | 0.15 | 0.15 | | 0.15 | | | 0.23 | 0.5 | |
| Anti-Wear (3) (wt %) | 0.1 | 0.1 | 0.1 | | | | | | 0.5 |
| Total additive treat rate in API Group II Oil for testing (wt %) | 1.5 | 1.25 | 1.35 | 1.40 | 1.25 | 1.5 | 1.23 | 1.5 | 1.5 |
| Phosphorous (%) | 0.041 | 0.022 | 0.030 | 0.032 | 0.019 | 0.038 | 0.020 | 0.047 | 0.044 |

[1]The hydraulic additive package contains antioxidants, rust inhibitor, dispersant, polyalkylene glycol, a metal deactivator, a friction modifier, demulsifier, foam inhibitor, and diluent oil.

The lubricating compositions so prepared were tested to evaluate demulsibility according to ASTM D1401, hydrolytic stability (water acidity) according to D2619, copper strip rating according to ASTM D130, and thermal stability according to ASTM D2070. The results are summarized in Table 2.

TABLE 2

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Water Separability (ASTM D1401) | 42-38-0 (10) | 41-38-1 (10) | 36/38/6 (30) | 40-37-3 (10) | 32-35-13 (30) | 34-35-11 (30) | 40-39-2 (5) | 40-39-1 (10) | 24-30-26 (30) |
| Hydrolytic Stability (D2619) | | | | | | | | | |
| Water acidity mg KOH | −0.22 | 0.28 | 0.28 | 0.84 | 0.28 | 0.28 | 1.35 | 3.36 | 0.28 |
| Copper strip rating (ASTM D130) | 2B | 2B | 2B | 2B | 2B | 2D | 1B | 4C | 1B |
| Fives Thermal Stability (ASTM D2070) | | | | | | | | | |
| Visual Rating | | | | | | | | | |
| Copper Rod Rating | 3 | 4 | 3 | 6 | 5 | 4 | 6 | 8 | 7 |
| Iron Rod Rating | 1 | 2 | 1 | 2 | 1 | 1 | 2 | 2 | 1 |
| Sludge, mg/100 mL | 8.4 | 21.4 | 17.5 | 17.3 | 15 | 15.9 | 27.4 | 32 | 13.4 |

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(A) an oil of lubricating viscosity;

(B) a first additive (1) represented by the formula

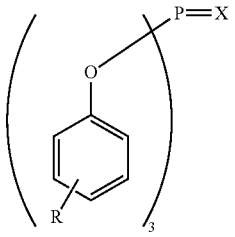

wherein R is a hydrogen or an alkyl group having 3 to 9 carbon atoms, and X is an oxygen atom or sulfur atom;

(C) a second additive (2) represented by the formula

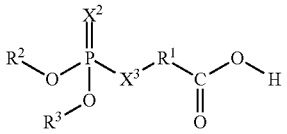

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and (D) a third additive (3) represented by the formula

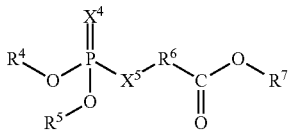

wherein $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms; $R^6$ is a linear or branched alkylene group having 1 to 8 carbon atoms, $X^4$ and $X^5$ are each independently an oxygen atom or sulfur atom; and wherein combination of additive (1), additive (2), and additive (3) is present in the lubricating composition in sufficient amounts to provide at least about 200 ppm phosphorous to the lubricating composition and wherein the first additive, second additive, and third additive, are present in ratios of 0.32 to 1.5 parts of the first additive, 0.5 to 2.5 parts of the second additive, and 1 part of the third additive.

2. The lubricating composition of claim 1 wherein the oil of lubricating viscosity comprises an API Group I oil.

3. The lubricating composition of claim 1 wherein the oil of lubricating viscosity comprises an API Group II oil.

4. The lubricating composition of claim 1 wherein the oil of lubricating viscosity comprises an API Group III oil.

5. The lubricating composition of claim 1 wherein, in additive (1), X is a sulfur atom.

6. The lubricating composition of claim 1 wherein the first additive, second additive, and third additive, are present in ratios of 0.32 to 1.5 parts of the first additive, 0.5 to 2.5 parts of the second additive, and 1 part of the third additive.

7. The lubricating composition of claim 1 further comprising one or more additional additives selected from the group consisting of antioxidants, corrosion inhibitors, rust inhibitors, foam inhibitors, dispersants, demulsifiers, metal deactivators, friction modifiers, detergents, emulsifiers, pour point depressants, viscosity modifiers, or any combination thereof.

8. The lubricating composition of claim 1 wherein the lubricating composition is substantially free of transition metals.

9. The lubricating composition of claim 1 wherein the lubricating composition is substantially free of poly(meth) acrylates.

10. A lubricating composition comprising:

(A) an oil of lubricating viscosity;

(B) an anti-wear additive package, wherein the anti-wear additive package consists of 0.32 to 1.5 parts of first anti-wear additive (1) represented by the formula

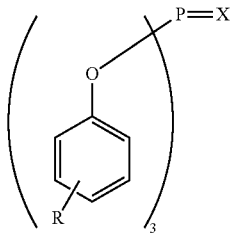

wherein R is a hydrogen or an alkyl group having 3 to 9 carbon atoms, and X is an oxygen atom or sulfur atom; 0.5 to 2.5 parts of a second anti-wear additive (2) represented by the formula

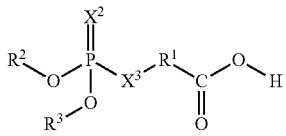

wherein $R^1$ is a linear or branched alkylene group having 1 to 8 carbon atoms, $R^2$ and $R^3$ each represent a hydrocarbon group having 3 to 20 carbon atoms, and $X^2$ and $X^3$ are each, independently, an oxygen atom or sulfur atom, or combinations thereof; and a 1 part of a third anti-wear additive (3) represented by the formula

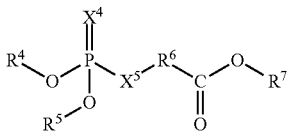

wherein $R^4$, $R^5$ and $R^7$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms; $R^6$ is a linear or branched alkylene group having 1 to 8 carbon atoms, $X^4$ and $X^5$ are each independently an oxygen atom or sulfur atom.

11. The lubricating composition of claim 10, wherein the anti-wear additive package is present in the lubricating composition in a sufficient amount to provide at least about 200 ppm phosphorous to the lubricating composition.

12. The lubricating composition of claim 10, wherein the lubricating composition further comprises:

up to 4% by weight of an antioxidant.

13. The lubricating composition of claim 10, further comprising:

up to 2% by weight of a dispersant.

14. The lubricating composition of claim 10, further comprising:

up to 5% by weight of a detergent.

15. The lubricating composition of claim 10, further comprising:

up 3% by weight of a friction modifier.

16. The lubricating composition of claim 10, further comprising:

up to 10% by weight of a viscosity modifier.

17. The lubricating composition of claim 10, further comprising:

up to 0.1% by weight of a metal deactivator.

18. The lubricating composition of claim 10, further comprising:

up to 3% by weight of an extreme pressure agent.

19. The lubricating composition of claim 10, wherein the lubricating composition comprises up to 5% by weight of the anti-wear additive package.

20. The lubricating composition of claim 10, wherein both $X^2$ and $X^3$ are oxygen atoms.

21. The lubricating composition of claim 10, wherein both $X^2$ and $X^3$ are sulfur atoms.

22. The lubricating composition of claim 10, wherein $X^2$ is oxygen and $X^3$ is sulfur.

23. The lubricating composition of claim 10, wherein $X^2$ is sulfur and $X^3$ is oxygen.

24. The lubricating composition of claim 10, wherein both $X^4$ and $X^5$ are oxygen atoms.

25. The lubricating composition of claim 10, wherein both $X^4$ and $X^5$ are sulfur atoms.

26. The lubricating composition of claim 10, wherein $X^4$ is oxygen and $X^5$ is sulfur.

27. The lubricating composition of claim 10, wherein $X^4$ is sulfur and $X^5$ is oxygen.

28. A method of lubricating a hydraulic system, a turbine system, or a circulating oil system comprising supplying to the hydraulic system, turbine system, or circulating oil system a lubricating composition comprising:

(A) an oil of lubricating viscosity;

(B) an anti-wear additive package, wherein the anti-wear additive package consists of a 0.32 to 1.5 parts of first anti-wear additive (1) represented by the formula

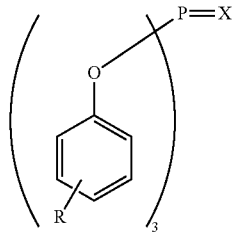

wherein R is a hydrogen or an alkyl group having 3 to 9 carbon atoms, and X is an oxygen atom or sulfur atom; 0.5 to 2.5 parts of a second anti-wear additive (2) represented by the formula

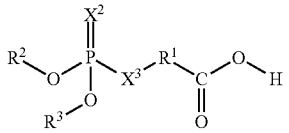

wherein $R^1$ is a linear or branched alkylene group having 1 to 8 carbon atoms, and $R^2$ and $R^3$ each represent a hydrocarbon group having 3 to 20 carbon atoms; and $X^2$ and $X^3$ are each, independently, an oxygen atom or sulfur atom, or combinations thereof; and a 1 part of a third anti-wear additive (3) represented by the formula

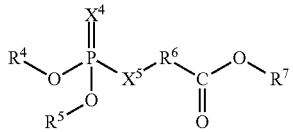

wherein $R^6$, $R^7$, and $R^9$ are each independently a linear or branched saturated or unsaturated cyclic aliphatic hydrocarbon group having 1 to 18 carbon atoms or a branched or unbranched saturated or unsaturated cyclic hydrocarbon group having 5 to 18 carbon atoms, $R^8$ is alkylene group having 1 to 8 carbon atoms, $X^4$ and $X^5$ are each independently an oxygen atom or sulfur atom.

* * * * *